US012535259B2

(12) United States Patent
Kim et al.

(10) Patent No.: US 12,535,259 B2
(45) Date of Patent: Jan. 27, 2026

(54) HEAT EXCHANGER HAVING A PLURALITY OF HEAT DISSIPATION FINS

(71) Applicant: LG ELECTRONICS INC., Seoul (KR)

(72) Inventors: Bongjun Kim, Seoul (KR); Sehyoun Kim, Seoul (KR); Minwoo Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 211 days.

(21) Appl. No.: 18/367,727

(22) Filed: Sep. 13, 2023

(65) Prior Publication Data

US 2024/0085121 A1 Mar. 14, 2024

(30) Foreign Application Priority Data

Sep. 13, 2022 (KR) ..... 10-2022-0114992

(51) Int. Cl.
*F25D 21/00* (2006.01)
*F25D 21/08* (2006.01)
*F28F 21/02* (2006.01)

(52) U.S. Cl.
CPC ..... *F25D 21/08* (2013.01); *F28F 21/02* (2013.01); *F28F 2215/00* (2013.01)

(58) Field of Classification Search
CPC ..... F25D 21/08; F28F 17/00; F28D 21/08
See application file for complete search history.

(56) References Cited

U.S. PATENT DOCUMENTS

2008/0196429 A1 8/2008 Petrenko et al.
2015/0293065 A1* 10/2015 Kissell ..... G01N 33/00 73/865.8
2020/0248852 A1 8/2020 Bostic, Jr.

FOREIGN PATENT DOCUMENTS

JP 2010-210103 A 9/2010
KR 10-2004-0086444 A 10/2004
KR 10-2010-0096553 A 9/2010

* cited by examiner

*Primary Examiner* — Eric S Ruppert
(74) *Attorney, Agent, or Firm* — Birch, Stewart, Kolasch & Birch, LLP

(57) ABSTRACT

A heat exchanger includes a plurality of refrigerant tubes through which refrigerant can flow; a plurality of collars surrounding at least a portion of an outer surface of each refrigerant tube; a plurality of heat dissipation fins connected to the plurality of collars; and an electrode in contact with each heat dissipation fin to transmit power to each heat dissipation fin. An electrical resistance of each collar is higher than an electrical resistance of each heat dissipation fin.

19 Claims, 8 Drawing Sheets

HEAT EXCHANGER HAVING A PLURALITY OF HEAT DISSIPATION FINS

CROSS-REFERENCE TO RELATED APPLICATIONS

This application claims the benefit under 35 U.S.C. § 119(a) to Patent Application No. 10-2022-0114992, filed in the Republic of Korea on Sep. 13, 2022, all of which is hereby expressly incorporated by reference into the present application.

TECHNICAL FIELD

This disclosure relates to a heat exchanger.

BACKGROUND

In general, a heat exchanger may be used as a condenser or an evaporator in a refrigeration cycle apparatus consisting of a compressor, a condenser, an expansion mechanism, and an evaporator.

In addition, the heat exchanger is installed in a room, a vehicle, a refrigerator, and the like to exchange heat between the refrigerant and the air.

The heat exchanger may be classified into a fin tube type heat exchanger, a micro channel type heat exchanger, and the like, depending on the structure.

The heat exchanger may include a plurality of refrigerant tubes in which a refrigerant flows and exchanges heat with external air, a heat transfer fin for connecting the plurality of refrigerant tubes to improve heat exchange capability, and a header for supplying refrigerant to the plurality of refrigerant tubes.

If the temperature of the refrigerant is lowered when the heat exchanger exchanges heat with the inside or outside air, and the temperature of the air that exchanges heat with the heat exchanger is a dew point temperature or less, frost (frosting) occurs around the fin of the heat exchanger.

At this time, the flow path is blocked due to the growth of frost between the fins and the performance of the heat exchanger is deteriorated. In order to remove such a frost, in Patent Document 1, a defrost cycle is implemented by reversing an air conditioner cycle, or by supplying some refrigerant discharged from the compressor to the heat exchanger.

In the case of Patent Document 1, there is a problem that since the heat exchanger is heated during the defrosting operation, the room or the inside of the refrigerator cannot be cooled, and the temperature inside the refrigerator or the room rises, and a problem that only the temperature of the refrigerant flowing in the refrigerant tube rises, and it takes a long time for heat to be transferred to the fins, which greatly increases the defrost time.

In the case of Patent Document 2, frosting performance is secured by adjusting the distance of the fins at unequal intervals in order to suppress frost forming between the fins. However, in this structure, there is a problem that frost grows on the fins of the heat exchanger.

Patent Document 1—Korean Publication No. 1020100096553

Patent Document 2—Korean Publication No. 1020047013258

SUMMARY

The disclosure has been made in view of the above problems, and may provide a heat exchanger capable of defrosting by generating heat by heat exchanger itself without a separate heater structure.

The disclosure may further provide a heat exchanger capable of defrosting fins of the heat exchanger even at low voltage.

The disclosure may further provide a heat exchanger capable of manufacturing a collar and a heat dissipation fin that are made of a different material as one body to be used as a heater.

The disclosure may further provide a heat exchanger that reduces the volume of the heat exchanger and prevents electric leakage of the electrode of the heat exchanger.

The tasks of the present disclosure are not limited to the tasks mentioned above, and other tasks not mentioned will be clearly understood by those skilled in the art from the following description.

In the heat exchanger according to the present disclosure, the electrical resistance of the collar of the heat exchanger is higher than the electrical resistance of the heat dissipation fin.

In addition, the present disclosure includes a first heat dissipation fin and a second heat dissipation fin having an electrical resistance higher than that of the first heat dissipation fin, and the electrical resistance of the collar is higher than the electrical resistance of the first heat dissipation fin.

Specifically, the present disclosure includes a plurality of refrigerant tubes through which refrigerant flows; a plurality of collars surrounding at least a portion of an outer surface of each refrigerant tube; a plurality of heat dissipation fins connected to the plurality of collars; and an electrode which is in contact with the heat dissipation fin and transmits power (current) to the heat dissipation fin, wherein an electrical resistance of the collar is higher than an electrical resistance of the heat dissipation fin.

The electrical resistance of the collar is higher than an electrical resistance of the refrigerant tube.

The collar includes: a base material made of an insulating material; a conductive particle made of a conductive material added to the base material.

The base material includes a synthetic resin.

The conductive particle is a metal.

The collar further includes an additive made of carbon.

The refrigerant tube and the heat dissipation fin are metal.

The heat dissipation fin connects between a plurality of collars adjacent to each other.

Each of the refrigerant tubes includes a first refrigerant pipe extending in a first direction; a second refrigerant pipe which extends in the first direction, and is spaced apart from the first refrigerant pipe; and a return pipe which connects one end of the first refrigerant pipe and one end of the second refrigerant pipe.

The plurality of collars are in contact with the first refrigerant pipe and the second refrigerant pipe.

The heat dissipation fin extends in a second direction intersecting the first direction.

A thickness of the heat dissipation fin becomes thinner as a distance from the collar increases.

The electrode includes a first electrode connected to one end of the heat dissipation fin; and a second electrode connected to the other end of the heat dissipation fin.

The heat dissipation fin further includes an electrode insertion portion surrounding at least a portion of the electrode.

A thickness of the collar is smaller than a width of the refrigerant tube.

A thickness of the collar is smaller than a radius of curvature of the return pipe.

A thickness of the collar is smaller than a separation distance of the heat dissipation fins adjacent to each other.

A thickness of the collar is smaller than a distance between the first refrigerant pipe and the second refrigerant pipe.

In addition, another embodiment of the present disclosure includes: a plurality of refrigerant tubes through which refrigerant flows; a plurality of collars surrounding at least a portion of an outer surface of each refrigerant tube; a plurality of heat dissipation fins connected to the plurality of collars; and an electrode which is in contact with the heat dissipation fin and transmits power to the heat dissipation fin, wherein the plurality of heat dissipation fins include: a first heat dissipation fin; and a second heat dissipation fin having an electrical resistance higher than an electrical resistance of the first heat dissipation fin, wherein an electrical resistance of the collar is higher than the electrical resistance of the first heat dissipation fin.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION

Exemplary embodiments of the present disclosure are described with reference to the accompanying drawings in detail. The same reference numbers are used throughout the drawings to refer to the same or like parts. Detailed descriptions of well-known functions and structures incorporated herein may be omitted to avoid obscuring the subject matter of the present disclosure.

Figure 1A:
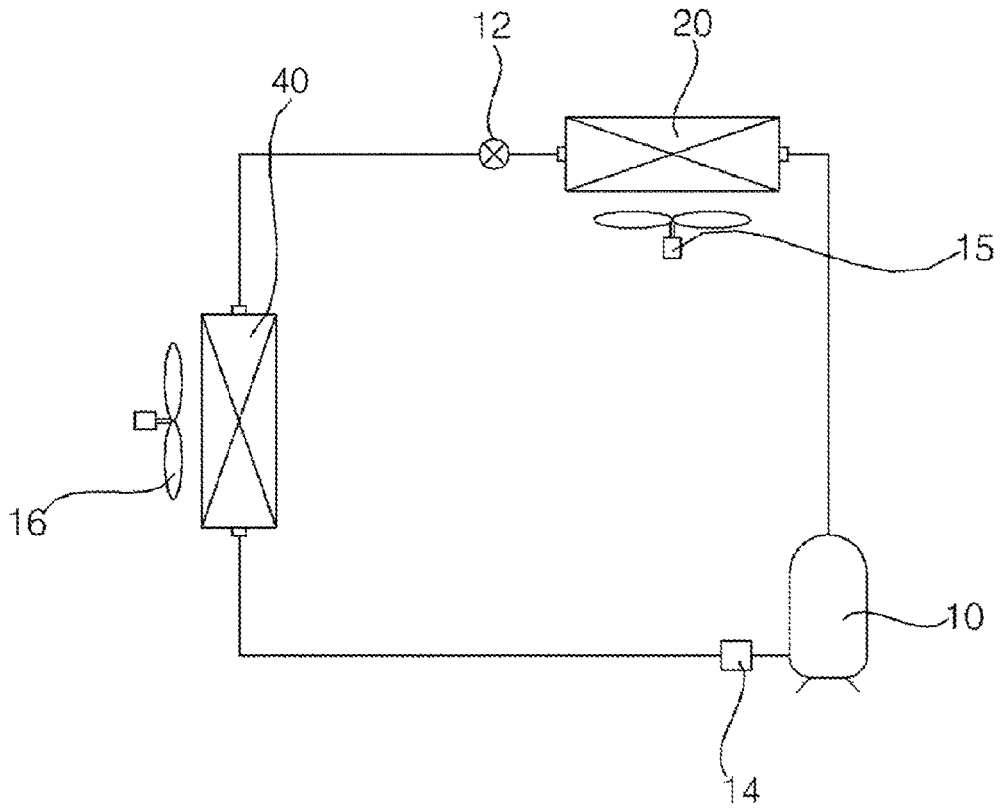
FIG. 1A is a block diagram showing a refrigerant cycle of a refrigerator according to a first embodiment of the present disclosure.
Figure 1B:
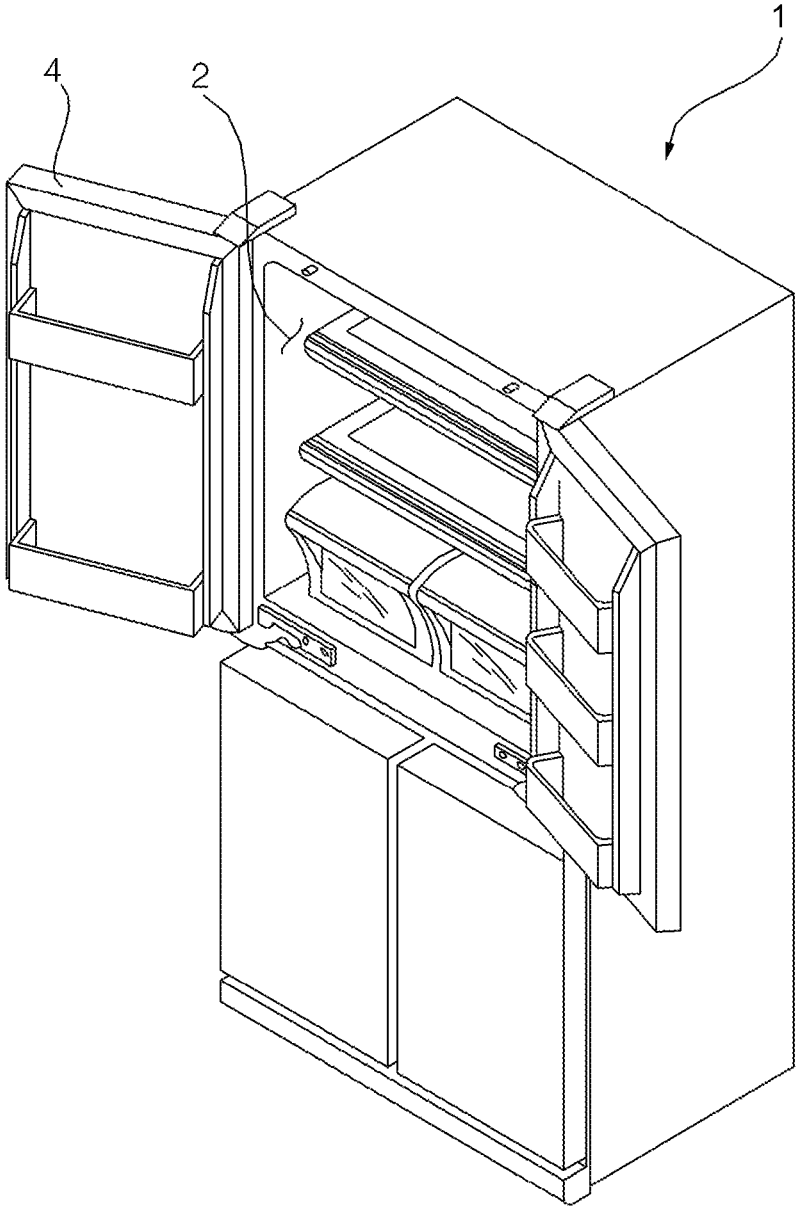
FIG. 1B is a perspective view of a refrigerator according to a first embodiment of the present disclosure.
Figure 2:
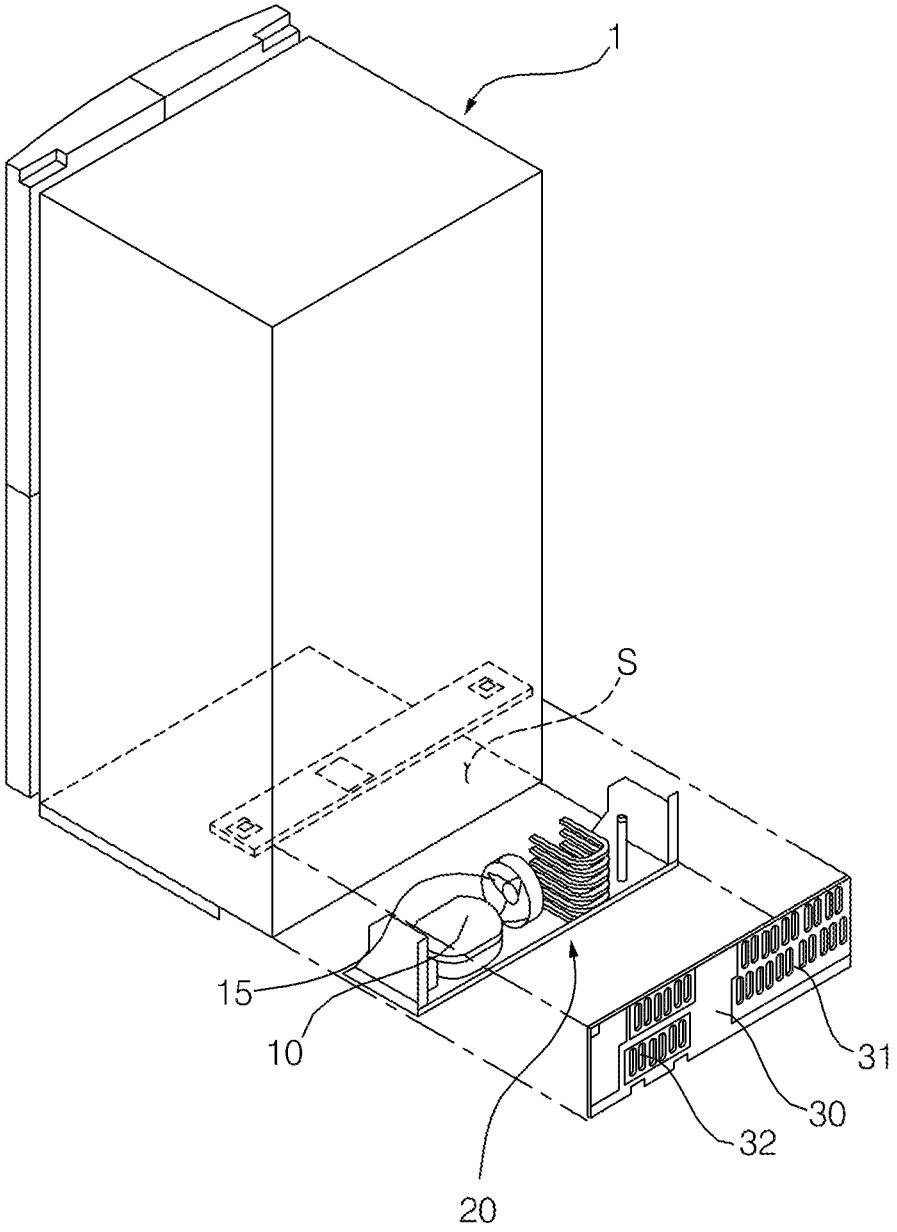
FIG. 2 is a perspective view of a machine room of the refrigerator shown in FIG. 1B.

FIG. 1A is a block diagram showing a refrigerant cycle of a refrigerator according to a first embodiment of the present disclosure, FIG. 1B is a perspective view of a refrigerator according to a first embodiment of the present disclosure, FIG. 2 is a perspective view of a machine room of the refrigerator shown in FIG. 1B.

Referring to FIGS. 1A, 1B and 2, a refrigerator according to an embodiment includes a main body 1 having a storage unit 2 in which food is stored, a door 4 for opening and closing the main body 1, and a cooling system for cooling the storage unit 2.

The cooling system of refrigerator according to the present embodiment may include a compressor 10 that compresses refrigerant, a condenser 20 that condenses refrigerant through heat exchange with outdoor air, an expansion mechanism 12 that expands refrigerant, and an evaporator 40 that evaporates refrigerant by heat exchange with air inside the refrigerator.

The refrigerant compressed in the compressor 10 may be condensed by exchanging heat with outdoor air while passing through the condenser 20. The condenser 20 is located in a machine room S provided inside the main body 1.

The refrigerant condensed in the condenser 20 may flow to the expansion mechanism 12 and expand. The refrigerant expanded by the expansion mechanism 12 may be evaporated through heat exchange with indoor air while passing through the evaporator 40. The evaporator 40 is disposed to exchange heat with the air in the storage unit 2.

The refrigerant evaporated in the evaporator 40 may be recovered to the compressor 10.

The refrigerant circulates through the compressor 10, the condenser 20, the expansion mechanism 12, and the evaporator 40 to operate in a cooling cycle.

A suction passage of the compressor 10 guiding the refrigerant passing through the evaporator 40 to the compressor 10 may be connected to the compressor 10. An accumulator 14 in which liquid refrigerant is accumulated may be installed in the suction passage of the compressor 10.

The machine room S may be located in the rear lower side of the main body 1. The machine room S may be formed in a shape extending to both lateral sides along the rear side of the main body 1.

The machine room S may include a rear cover 30. The rear cover 30 may be provided to open and close the rear side of the machine room S. The rear cover 30 may be provided with an air inlet 31 through which air is flowed into the machine room S and an air outlet 32 through which the air inside the machine room S is discharged to the outside. Each of the air inlet 31 and the air outlet 32 may be provided in plurality. The air inlet 31 and the air outlet 32 may be provided at different positions on the rear cover 30 or may be provided at positions facing each other.

A condenser fan 15 for blowing outdoor air to the condenser 20 may be installed in the machine room S. An evaporator fan 16 for blowing indoor air to the evaporator 40 may be installed.

Although a refrigerator is described as an example for use of the heat exchanger, the refrigerator is just an example of the use of the heat exchanger in an appliance. The present disclosure is not limited to just refrigerators; rather, the heat exchanger could be used in other appliances including a general air conditioner for cooling a room.

The condenser and evaporator may be configured of a heat exchanger. Hereinafter, a description of the heat exchanger is replaced with a description of the evaporator.

Figure 3:
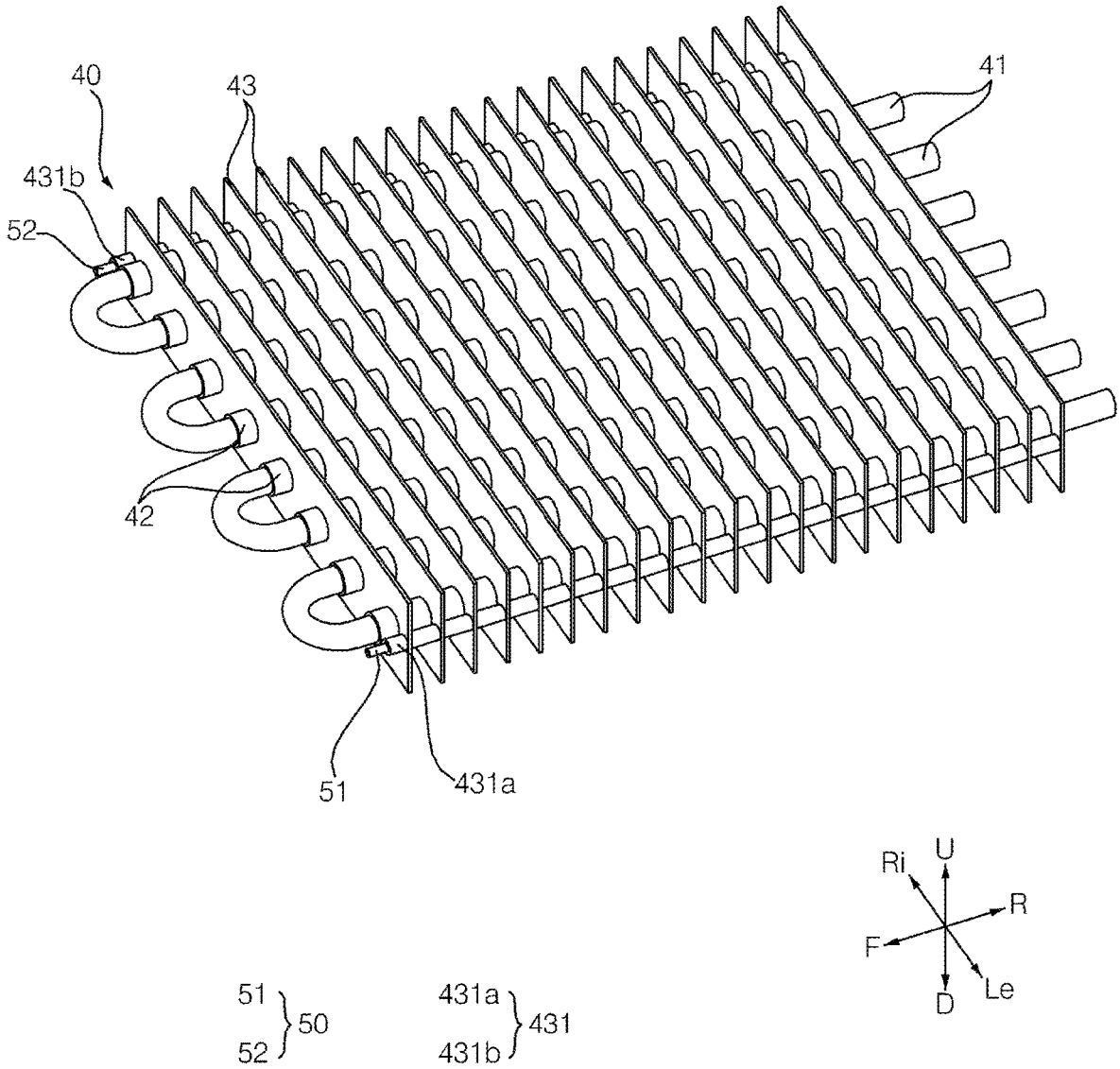
FIG. 3 is a perspective view of an evaporator shown in FIG. 1A.
Figure 4:
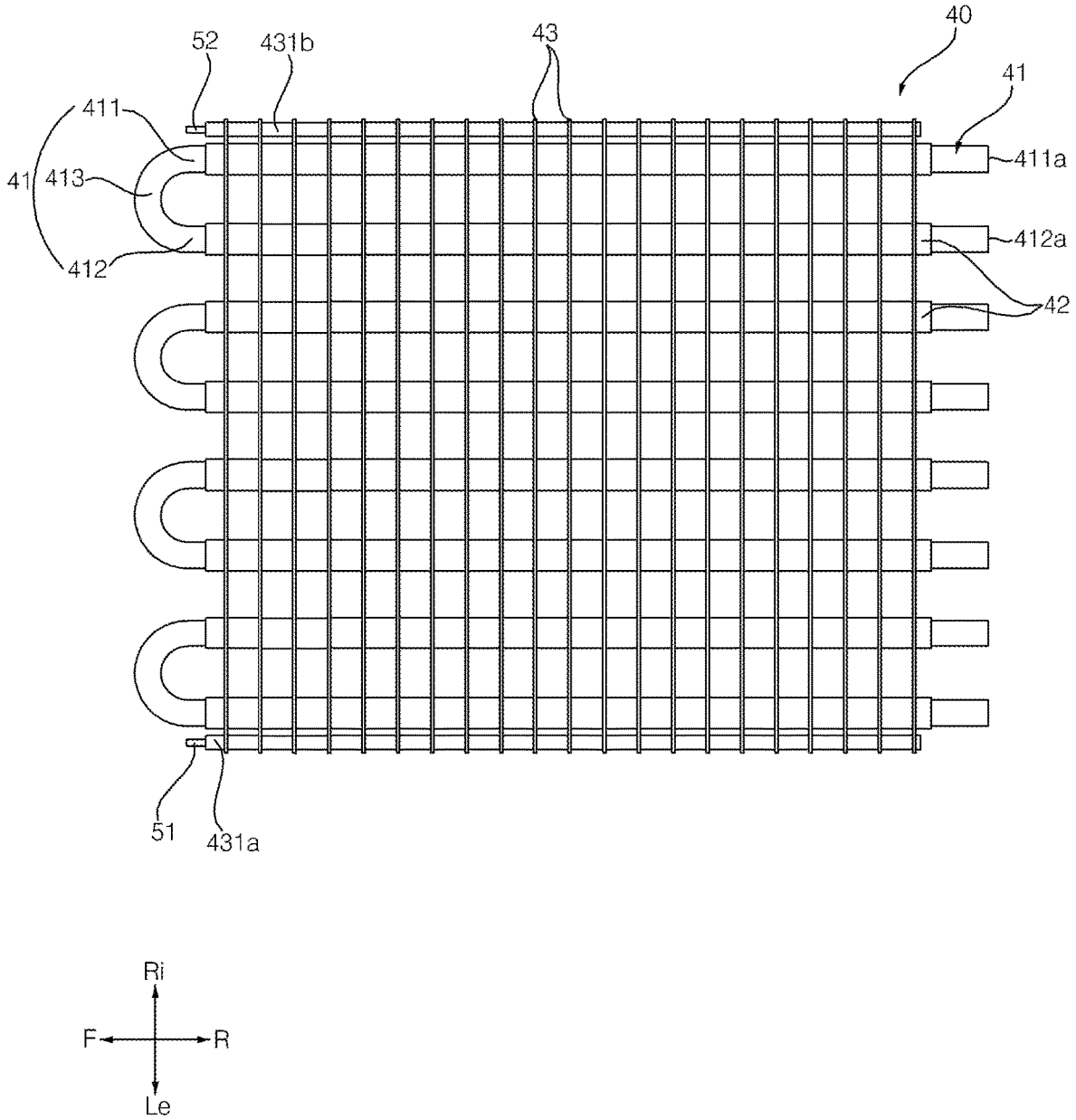
FIG. 4 is a plan view of the evaporator shown in FIG. 3.

FIG. 3 is a perspective view of an evaporator shown in FIG. 1A, and FIG. 4 is a plan view of the evaporator shown in FIG. 3.

Referring to FIGS. 2 to 4, the evaporator 40 is configured of a heat exchanger, and the evaporator 40 includes a plurality of refrigerant tubes 41 through which refrigerant flows, a plurality of collars 42 surrounding at least a portion of the outer surface of each refrigerant tube 41, a plurality of heat dissipation fins 43 connected to the plurality of collars 42, and an electrode 50 that is in contact with the heat dissipation fin 43 and transmits power (current) to the heat dissipation fin 43.

The refrigerant tube 41 provides a space through which refrigerant flows. The refrigerant expanded by the expansion mechanism 12 flows into the refrigerant tube 41.

The refrigerant tube 41 may be formed of one pipe or a plurality of pipes, but is not limited thereto.

For example, each refrigerant tube 41 may include a first refrigerant pipe 411 extending in a first direction, a second refrigerant pipe 412 that extends in the first direction and is spaced apart from the first refrigerant pipe 411, and a return pipe 413 connecting one end of the first refrigerant pipe 411 and one end of the second refrigerant pipe 412.

Here, the first direction means a front-rear direction FR.

The other end of the first refrigerant pipe 411 may include a refrigerant inlet 411*a* into which refrigerant flows. The refrigerant inlet 411*a* may be connected to a header (not shown) distributing the refrigerant, and the header may be connected to the expansion mechanism 12.

The second refrigerant pipe 412 extends in the first direction and is spaced apart from the first refrigerant pipe 411. Specifically, the second refrigerant pipe may be spaced apart in a second direction intersecting the first direction. Here, the second direction means the left-right direction (Le, Ri).

The other end of the second refrigerant pipe 412 may include a refrigerant outlet 412*a* through which refrigerant flows out. The refrigerant outlet 412*a* may be connected to a collection header (not shown) for collecting refrigerant, and the collection header may be connected to the compressor 10.

The return pipe 413 connects one end of the first refrigerant pipe 411 and one end of the second refrigerant pipe 412. The return pipe 413 changes the direction of the refrigerant. The return pipe 413 may have a U-shape.

If the radius of curvature R of the return pipe 413 is too large, the volume of the evaporator 40 increases, and if it is too small, the refrigerant tube 41 is damaged. Accordingly, the radius of curvature R of the return pipe 413 may be smaller than the distance between the first refrigerant pipe 411 and the second refrigerant pipe 412, and may be larger than the distance between adjacent heat dissipation fins 43.

The refrigerant expanded in the expansion mechanism 12 is supplied to the first refrigerant pipe 411 through the refrigerant inlet, and the refrigerant supplied to the first refrigerant pipe 411 is discharged to the second refrigerant pipe 412 via the return pipe 413.

The refrigerant tube 41 may be made of a material having excellent thermal conductivity. For example, the refrigerant tube 41 may include a metallic material. Specifically, the refrigerant tube 41 may include copper, aluminum, and alloys thereof.

Each collar 42 covers the outer surface of at least a portion of each refrigerant tube 41. Each collar 42 forms a hole into which the refrigerant tube 41 is inserted. The collar 42 transfers cold air from the refrigerant tube 41 to the heat dissipation fin 43.

Specifically, each collar 42 may be installed only in a straight portion of the refrigerant tube 41. For example, each collar 42 may be in contact with the first refrigerant pipe 411 and the second refrigerant pipe 412. That is, each collar 42 is disposed to surround at least a portion of the first refrigerant pipe 411 and at least a portion of the second refrigerant pipe 412.

More specifically, each collar 42 may be installed so that both ends of the first refrigerant pipe 411 and both ends of the second refrigerant pipe 412 are exposed. When both ends of the first refrigerant pipe 411 and both ends of the second refrigerant pipe 412 are exposed, the header can be easily installed and deformation and damage to the return pipe 413 can be reduced.

The material of each collar 42 may be a material having excellent thermal conductivity and high electrical conductivity. The material of the collar 42 will be described later.

The heat dissipation fin 43 is connected to a plurality of collars 42. The heat dissipation fin 43 exchanges the cold air or heat transmitted by the collar 42 with outside air. The heat dissipation fin 43 has a larger contact area than the collar 42 and the refrigerant tube 41.

The heat dissipation fin 43 connects a plurality of collars 42 adjacent to each other. Accordingly, the heat dissipation fin 43 connects a plurality of refrigerant tubes 41 spaced apart from each other.

The heat dissipation fin 43 may extend in a second direction (left-right direction) intersecting the first direction. A plurality of heat dissipation fins 43 may be arranged in a front-rear direction. It is preferable that the pitch of the plurality of heat dissipation fins 43 is constant.

Each heat dissipation fin 43 may have a plate shape. Specifically, the heat dissipation fin 43 may have a rectangular plate shape. More specifically, the area of the heat dissipation fin 43 viewed from the front-rear direction may be greater than the area viewed from the left-right direction and the area viewed from the up-down direction.

In addition, the length of each heat dissipation fin 43 in the left-right direction may be longer than the length in the front-rear direction and the length in the up-down direction of the heat dissipation fin 43.

A material having excellent thermal conductivity may be used as the heat dissipation fin 43. For example, the heat dissipation fin 43 may include a metallic material. Specifically, the heat dissipation fin 43 may include copper, aluminum, and alloys thereof.

Meanwhile, the heat dissipation fin 43 may further include an electrode insertion portion 431 surrounding at least a portion of the electrode 50. The electrode insertion portion 431 restricts exposure of the electrode 50 to the outside, prevents leakage current from occurring in the electrode 50, and protects the electrode 50 from external impact and dust.

The electrode insertion portion 431 may have a shape corresponding to the electrode 50. Specifically, the electrode insertion portion 431 may have a cylindrical shape having a space therein.

The electrode insertion portion 431 may be located in both ends of the heat dissipation fin 43. Specifically, the electrode insertion portion 431 may include a first electrode insertion portion 431*a* disposed in one end of the heat dissipation fin 43 and a second electrode insertion portion 431*b* disposed in the other end of the heat dissipation fin 43.

The first electrode insertion portion 431*a* and the second electrode insertion portion 431*b* may be disposed in both ends of the heat dissipation fin 43 in the length direction. The heat dissipation fin 43 extends long in the left-right direction. The first electrode insertion portion 431*a* may be disposed in the left end of the heat dissipation fin 43, and the second electrode insertion portion 431*b* may be disposed in the right end of the heat dissipation fin 43.

The electrode 50 is in contact with the heat dissipation fin 43 to transmit power to the heat dissipation fin 43. The electrode 50 may be connected to an external power source and connected to both ends of the heat dissipation fin 43 in the length direction.

Specifically, the electrode 50 may include a first electrode 51 connected to one end of the heat dissipation fin 43 and a second electrode 52 connected to the other end of the heat dissipation fin 43. More specifically, the first electrode 51 is connected to the left end of the heat dissipation fin 43, and the second electrode 52 is connected to the right end of the heat dissipation fin 43.

The electrode 50 may be inserted into the electrode insertion portion 431. Specifically, the first electrode 51 may be inserted into a first electrode insertion portion 431*a*, and the second electrode 52 may be inserted into a second electrode insertion portion 431*b*.

A part of the first electrode 51 is exposed to the outside of the first electrode insertion portion 431*a*, and a part of the second electrode 52 is exposed to the outside of the second electrode insertion portion 431*b*, so that the connection between the power supply unit and the electrode 50 is facilitated.

In the present disclosure, in order to generate heat by the heat exchanger itself, the electrical resistance of the collar 42 is higher than that of the heat dissipation fin 43. In addition, the electrical resistance of the collar 42 is higher than that of the refrigerant tube 41.

When the refrigerant tube 41 generates heat by increasing the electrical resistance of the refrigerant tube 41, it is difficult to remove frost between the heat dissipation fins 43, and when the heat dissipation fins 43 generate heat by increasing the electrical resistance of the heat dissipation fins 43, the electricity consumption becomes very high, and the heat exchange performance deteriorates.

Therefore, if the collar 42 serves as an electrical resistor, and serves as a heating element when energized, it can be driven even at a moderately low voltage, and it is also effective in defrosting because the heat transfer can be performed evenly to the refrigerant tube 41 and the heat dissipation fin 43.

Therefore, the present disclosure has the advantage of reducing the installation cost of the heater and reducing the installation space of the heat exchanger, because a separate heater is not installed as the heat exchanger itself can generate heat and defrost without a separate heater structure.

The collar 42 may include a mixture or compound of a plurality of materials. Specifically, the collar 42 may include a base material made of an insulating material and conductive particles made of a conductive material added to the base material.

The base material is an insulating material, and serves to increase electrical resistance. Specifically, the base material may include a synthetic resin. The base material is preferably nylon.

Conductive particles are mixed with the base material. A plurality of conductive particles are dispersed and positioned on the base material. Conductive particles may include a conductive material. Specifically, the conductive particles may include a metal material. Preferably, the conductive particles may include copper or aluminum.

The collar 42 may further include an additive made of carbon. The additive enhances the thermal conductivity of the collar 42.

Therefore, in the present disclosure, in the heat exchanger, since the collar 42 has high electrical resistance, the heat dissipation fin 43 and the refrigerant tube 41 have low electrical resistance, and the material of the collar 42 is made of conductive particles and carbon additives on an insulating material base, it operates at a low voltage, so that there is an advantage of reducing power consumption.

Figure 5:
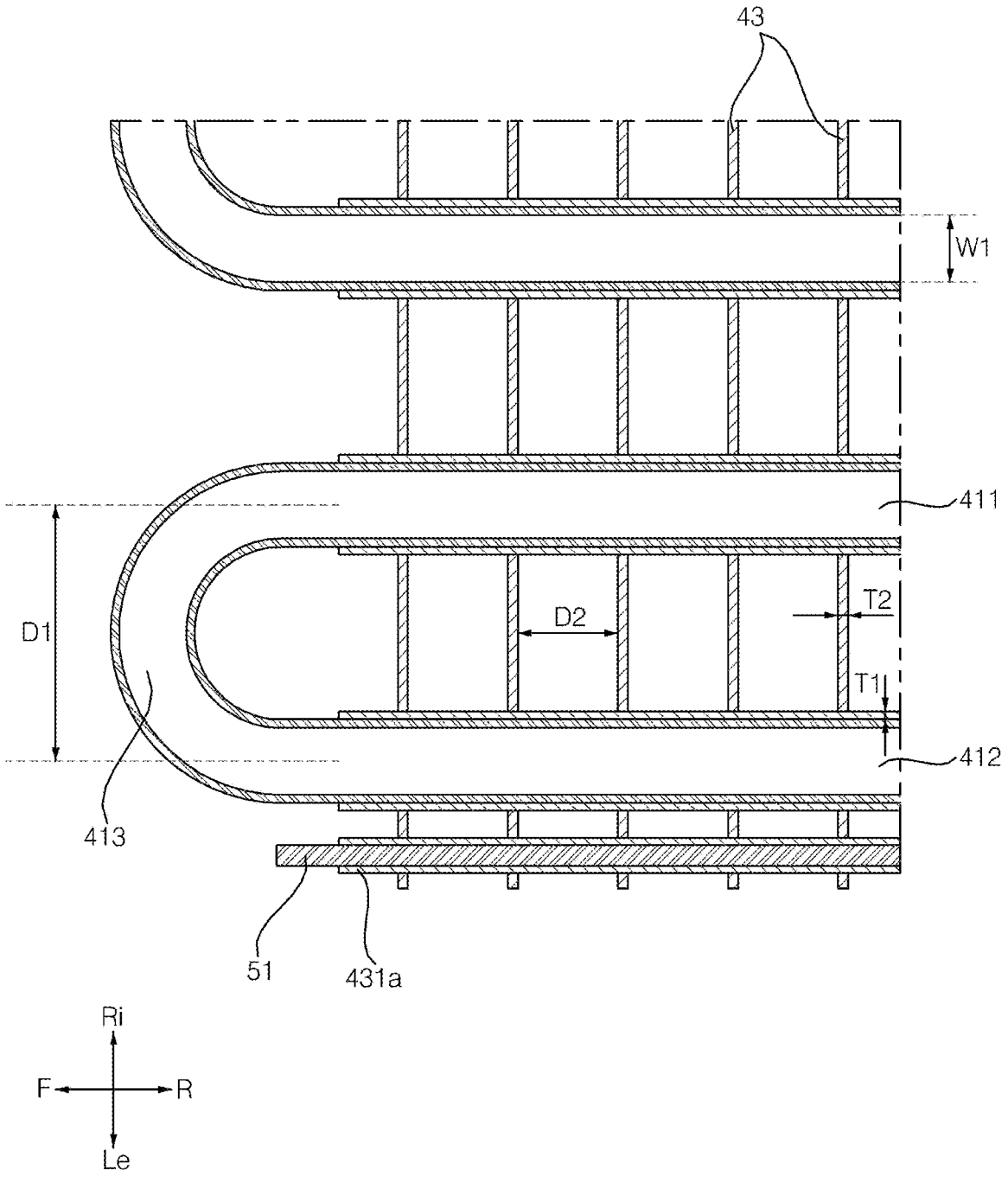
FIG. 5 is a partial cross-sectional view of the evaporator shown in FIG. 4.

FIG. 5 is a partial cross-sectional view of the evaporator shown in FIG. 4.

Referring to FIG. 5, it is preferable that the thickness T1 of the collar 42 has a thickness that efficiently transfers cold air or heat from the refrigerant tube 41 to the heat dissipation fin 43. The thickness T1 of the collar 42 may be smaller than a width W1 of the refrigerant tube 41.

In addition, the thickness T1 of the collar 42 may be smaller than the radius of curvature R of the return pipe 413. The thickness T1 of the collar 42 may be smaller than a separation distance D2 of adjacent heat dissipation fins 43.

The thickness T1 of the collar 42 may be smaller than a distance D1 between the first refrigerant pipe 411 and the second refrigerant pipe 412.

Preferably, the thickness T1 of the collar 42 may be 0.5 mm to 1.5 mm. This is because if the thickness T1 of the collar 42 is too thick, it is difficult to transmit the heat between the refrigerant tube 41 and the heat dissipation fin 43, and if the thickness T1 of the collar 42 is too thin, the fixing force of the heat dissipation fin 43 is weak.

The thickness T1 of the collar 42 may have a thickness of 80% to 120% compared to the thickness T2 of the heat dissipation fin 43. Preferably, the thickness T1 of the collar 42 may be the same as that of the heat dissipation fin 43.

Figure 6:
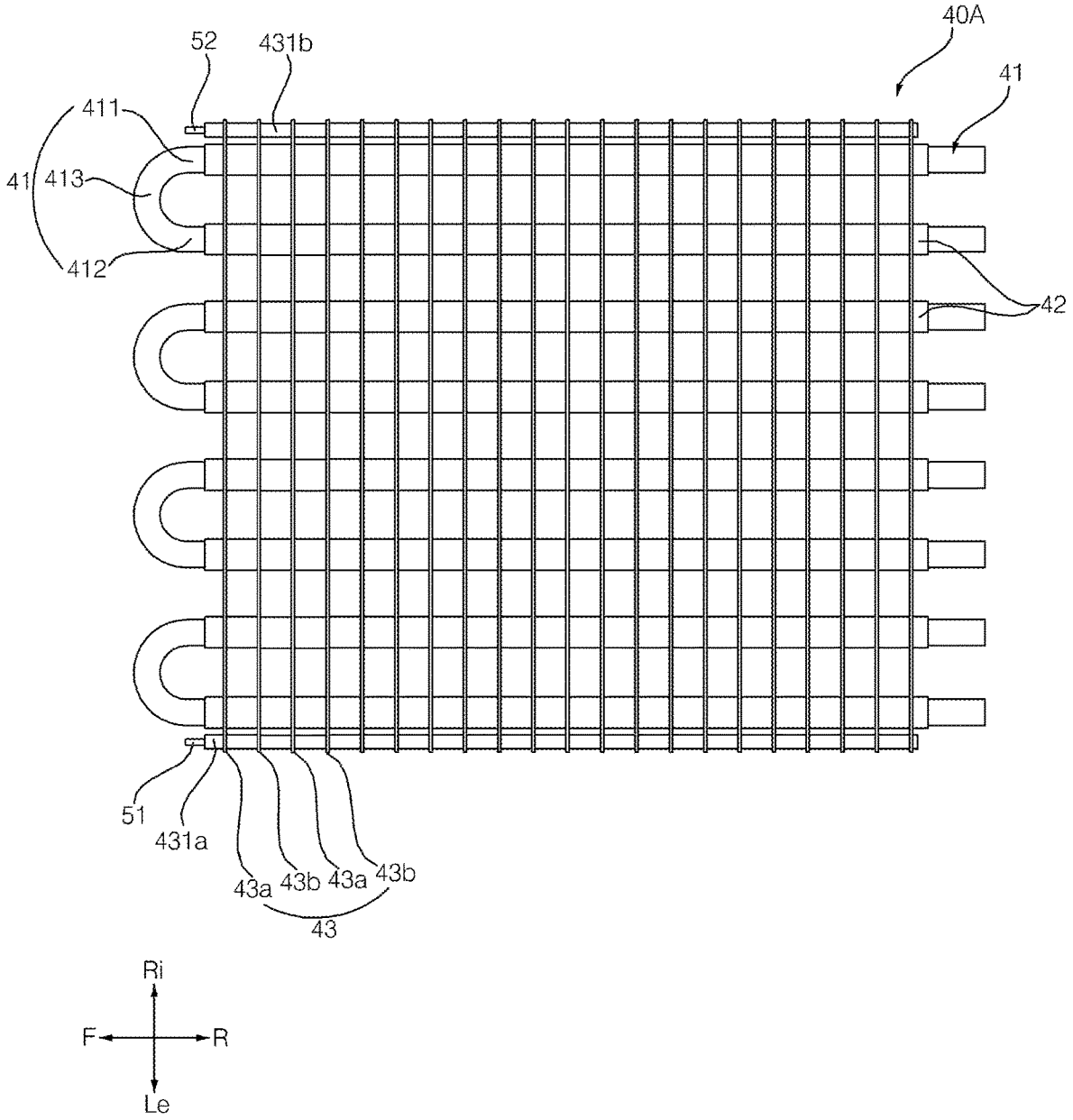
FIG. 6 is a plan view of an evaporator according to a second embodiment of the present disclosure.

FIG. 6 is a plan view of an evaporator according to a second embodiment of the present disclosure.

Referring to FIG. 6, in the evaporator 40A according to the second embodiment, there is a difference in the material of the heat dissipation fins 43 compared to the first embodiment. Hereinafter, differences from the first embodiment will be mainly described. Configurations not specifically described in the second embodiment are regarded as the same as those in the first embodiment.

The plurality of heat dissipation fins 43 may have different materials or different electrical resistances.

For example, the plurality of heat dissipation fins 43 may include a first heat dissipation fin 43*a* and a second heat dissipation fin 43*b* having an electrical resistance higher than that of the first heat dissipation fin 43*a*. At this time, the electrical resistance of the collar 42 may be higher than that of the first heat dissipation fin 43*a*.

When it is not easy to remove the frost only by the heat of the collar 42 because the second heat dissipation fin 43*b* has a higher electrical resistance than the first heat dissipation fin 43*a*, the second heat dissipation fin 43*b* generates heat, so that the frost can be quickly removed.

The first heat dissipation fin 43*a* and the second heat dissipation fin 43*b* may be alternately disposed in the front-rear direction. As another example, the ratio of the first heat dissipation fin 43*a* to the number of second heat dissipation fins 43*a* may be 3:1.

The first heat dissipation fin 43*a* is made of a metal material, and the second heat dissipation fin 43*b* may include a base material made of an insulating material and conductive particles made of a conductive material added to the base material.

Specifically, the base material may include a synthetic resin. The base material is preferably nylon. Conductive particles are mixed with the base material. A plurality of conductive particles are dispersed and positioned on the base material. Specifically, the conductive particles may include a metal material. Preferably, the conductive particles may include copper or aluminum. The second heat dissipation fin 43*b* may further include an additive made of carbon.

Figure 7:
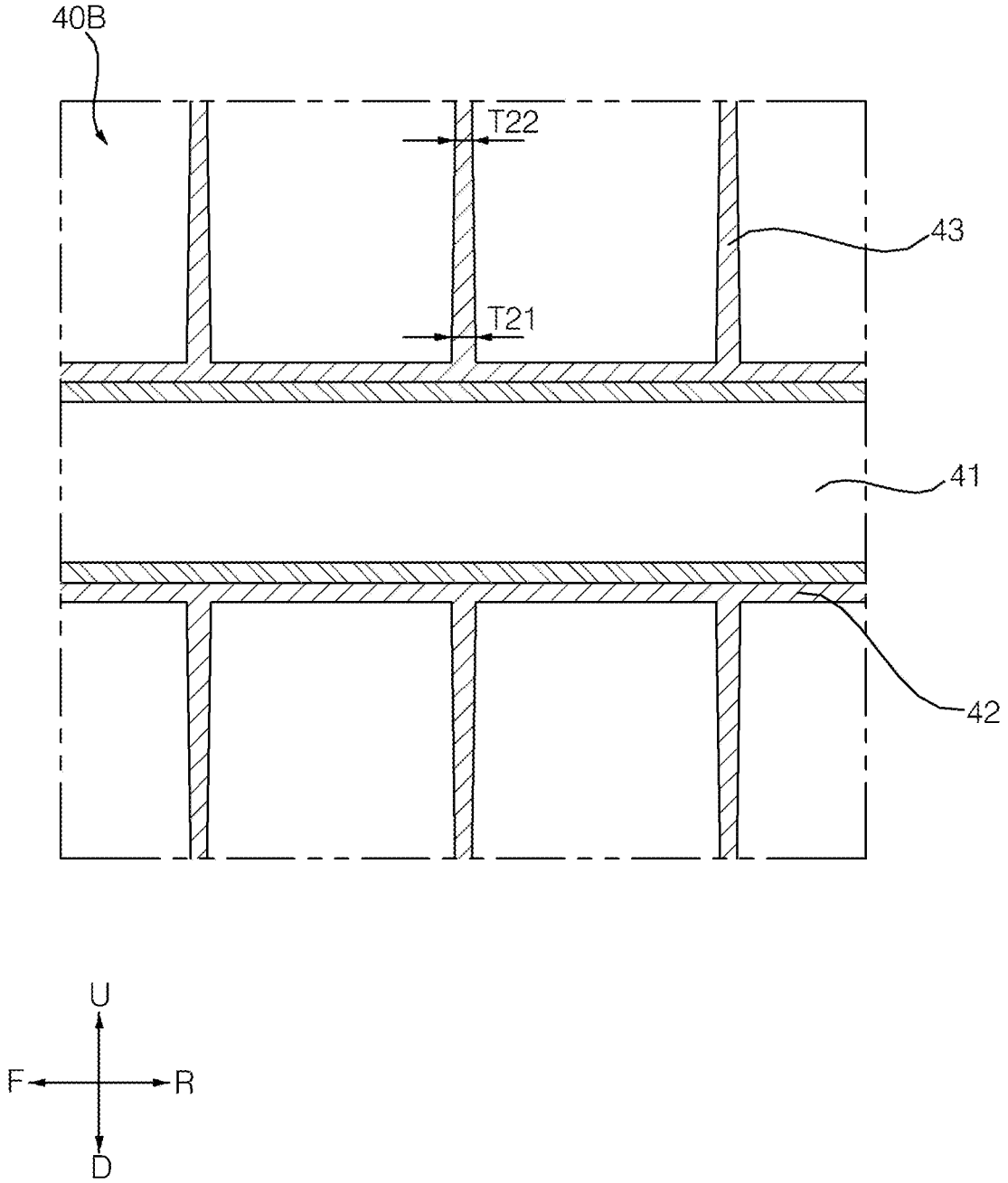
FIG. 7 is a cross-sectional view of an evaporator according to a third embodiment of the present disclosure.

FIG. 7 is a cross-sectional view of an evaporator according to a third embodiment of the present disclosure.

Referring to FIG. 7, in the evaporator 40B according to the third embodiment, there is a difference in the thickness of the heat dissipation fins 43 compared to the first embodiment. Compared to the second embodiment, the evaporator according to the third embodiment has a difference in the thickness of the heat dissipation fins 43.

That is, the third embodiment of FIG. 7 can be combined with the first embodiment or the second embodiment.

Hereinafter, differences from the first embodiment or the second embodiment will be mainly described. Configurations not specifically described in the third embodiment are regarded as the same as those of the first or second embodiment.

The heat dissipation fin 43 may have a constant thickness. However, if the thickness of the heat dissipation fin 43 is constant, it is difficult to come out of the molding frame during molding, and manufacturing efficiency may decrease.

Accordingly, the thickness of the heat dissipation fin 43 may be thinner as the distance from the collar 42 increases. Alternatively, the thickness T21 of the portion adjacent to the collar 42 of the heat dissipation fin 43 may be greater than the thickness T22 of the portion far from the collar 42 of the heat dissipation fin 43.

The thickness of the heat dissipation fin 43 may gradually or stepwise decrease as the distance from the collar 42 increases. Preferably, the thickness of the heat dissipation fin 43 is constant in the left-right direction, and the thickness of the heat dissipation fin 43 in the up-down direction may decrease as the distance from the collar 42 increases. This is because it is molded with two molding frames in the up-down direction.

The heat exchanger of the present disclosure has one or more of the following effects.

First, the present disclosure has the advantage of reducing the installation cost of the heater and reducing the installation space of the heat exchanger because a separate heater is not installed as the heat exchanger itself can generate heat and defrost without a separate heater structure.

Second, in the present disclosure, in the heat exchanger, since the collar has high electrical resistance, the heat dissipation fin and the refrigerant tube have low electrical resistance, and the material of the collar is made of conductive particles and carbon additives on an insulating material base, it operates at a low voltage, so that there is an advantage of reducing power consumption.

Third, the present disclosure has an advantage in that the collar and the heat dissipation fin are easily manufactured as one body because the thickness of the heat dissipation fin is thinner as the distance from the collar is increased, and the material of the collar is composed of conductive particles and carbon additives on an insulating material base.

Fourth, the present disclosure has an advantage in that the electrode is protected from an external leakage element because an electrode insertion portion into which an electrode is inserted is provided at both ends of the heat dissipation fin, and the electrode is inserted into the electrode insertion portion.

Fifth, the present disclosure has the advantage of being able to defrost without deteriorating the performance of the heat exchanger, by changing only the material of the collar to a composite material.

While the present disclosure has been particularly shown and described with reference to exemplary embodiments thereof, it will be understood by those of ordinary skill in the art that various changes in form and detail may be made herein without departing from the spirit and scope of the present disclosure as defined by the following claims and such modifications and variations should not be understood individually from the technical idea or aspect of the present disclosure.

What is claimed is:

1. A heat exchanger comprising:

a plurality of refrigerant tubes configured to allow refrigerant to flow therethrough;

a plurality of collars, each collar surrounding at least a portion of an outer surface of a corresponding refrigerant tube;

a plurality of heat dissipation fins connected to the plurality of collars; and an electrode in contact with each heat dissipation fin to transmit power to each heat dissipation fin, wherein an electrical resistance of each collar is higher than an electrical resistance of each heat dissipation fin, and wherein a thickness of each heat dissipation fin decreases between adjacent collars.

2. The heat exchanger of claim 1, wherein the electrical resistance of each collar is higher than an electrical resistance of each refrigerant tube.

3. The heat exchanger of claim 1, wherein each collar comprises:

a base material made of an insulating material; and conductive particles made of a conductive material added to the base material.

4. The heat exchanger of claim 3, wherein the base material comprises a synthetic resin.

5. The heat exchanger of claim 4, wherein the conductive material is a metal.

6. The heat exchanger of claim 4, wherein each collar further comprises an additive made of carbon.

7. The heat exchanger of claim 1, wherein each refrigerant tube and each heat dissipation fin are metal.

8. The heat exchanger of claim 1, wherein each heat dissipation fin connects at least two collars of the plurality of collars to each other.

9. The heat exchanger of claim 1, wherein each of the refrigerant tubes comprises:

a first refrigerant pipe having a centerline extending in a first direction;

a second refrigerant pipe having a center line extending in the first direction, the second refrigerant pipe being spaced apart from the first refrigerant pipe; and a return pipe connecting one end of the first refrigerant pipe to one end of the second refrigerant pipe.

10. The heat exchanger of claim 9, wherein the plurality of collars include a first plurality of collars in contact with the first refrigerant pipe and a second plurality of collars in contact with the second refrigerant pipe.

11. The heat exchanger of claim 9, wherein each heat dissipation fin extends in a second direction intersecting the first direction.

12. The heat exchanger of claim 1, wherein the electrode comprises:

a first electrode connected to a first end of each heat dissipation fin; and a second electrode connected to a second end of each heat dissipation fin.

13. The heat exchanger of claim 1, wherein each heat dissipation fin further comprises an electrode insertion portion surrounding at least a portion of the electrode.

14. The heat exchanger of claim 1, wherein a thickness of each collar is smaller than a width of the corresponding refrigerant tube.

15. The heat exchanger of claim 1, wherein a thickness of each collar is smaller than a separation distance of adjacent heat dissipation fins.

16. The heat exchanger of claim 1, wherein each collar is connected to at least two heat dissipation fins of the plurality of heat dissipation fins.

17. An appliance comprising the heat exchanger of claim 1.

18. A heat exchanger comprising:

a plurality of refrigerant tubes configured to allow refrigerant to flow therethrough, each refrigerant tube having:

a first refrigerant pipe having a centerline extending in a first direction;

a second refrigerant pipe having a center line extending in the first direction, the second refrigerant pipe being spaced apart from the first refrigerant pipe; and a return pipe connecting one end of the first refrigerant pipe to one end of the second refrigerant pipe;

a plurality of collars, each collar surrounding at least a portion of an outer surface of a corresponding refrigerant tube;

a plurality of heat dissipation fins connected to the plurality of collars; and an electrode in contact with each heat dissipation fin to transmit power to each heat dissipation fin, wherein an electrical resistance of each collar is higher than an electrical resistance of each heat dissipation fin, and wherein a thickness of each collar is smaller than a radius of curvature of the return pipe.

19. A heat exchanger comprising:

a plurality of refrigerant tubes configured to allow refrigerant to flow therethrough;

a plurality of collars, each collar surrounding at least a portion of an outer surface of a corresponding refrigerant tube;

a plurality of heat dissipation fins connected to the plurality of collars; and an electrode in contact with each heat dissipation fin to transmit power to each heat dissipation fin, wherein the plurality of heat dissipation fins comprise:

a first heat dissipation fin; and a second heat dissipation fin having an electrical resistance higher than an electrical resistance of the first heat dissipation fin, and wherein an electrical resistance of each collar is higher than an electrical resistance of the first heat dissipation fin.

* * * * *